US005651717A

United States Patent [19]

Hamilton et al.

[11] Patent Number: 5,651,717

[45] Date of Patent: Jul. 29, 1997

[54] ACTUATING MECHANISM FOR DOLL

[75] Inventors: Patricia Hamilton, 1814 Montgomery Dr., Santa Rosa, Calif. 95405; Tom Louchard, Santa Rosa, Calif.

[73] Assignee: Patricia Hamilton, Santa Rosa, Calif.

[21] Appl. No.: 650,950

[22] Filed: May 20, 1996

Related U.S. Application Data

[63] Continuation of Ser. No. 520,610, Aug. 30, 1995, abandoned.

[51] Int. Cl.[6] ..... A63H 3/20

[52] U.S. Cl. ..... 446/330; 446/362

[58] Field of Search ..... 446/330, 354, 446/359, 361, 362, 298, 331, 334, 336, 365

[56] References Cited

U.S. PATENT DOCUMENTS

| | | | |
|---|---|---|---|
| 2,669,063 | 2/1954 | Lang | 446/320 |
| 3,053,008 | 9/1962 | Pelunis | 446/330 |
| 3,125,828 | 3/1964 | Ostrander | 446/330 |
| 4,212,132 | 7/1980 | Lewanoni . | |
| 4,601,671 | 7/1986 | DeMars | 446/330 |
| 4,802,878 | 2/1989 | Terzian et al. | 446/300 |
| 5,378,188 | 1/1995 | Clark | 446/330 |

FOREIGN PATENT DOCUMENTS

| | | | |
|---|---|---|---|
| 1042944 | 11/1953 | France | 446/330 |

*Primary Examiner*—Mickey Yu
*Attorney, Agent, or Firm*—Jack Lo

[57] ABSTRACT

An actuating mechanism for a doll includes a pair of arms rotatably attached to a body member for rotation about a horizontal axis, and a lever connected to the proximal ends of the arms. The first end of a deflectable member is attached to the body member, and the second of the deflectable member is movable along the body member. The deflectable member include outwardly bowing intermediate portions. The first ends of a pair of tendons are attached to the arms, and the second ends are anchored to the body member at a point between the ends of the deflectable member. The tendon is curved around the second end of the deflectable member, past the first end, and into the arms through the lever. When the deflectable member is compressed, such as when the doll is hugged by a person, its second end is deflected away from the first end. The tendons are thus pulled by the second end of the deflectable member, and the lever is rotated by the tendons to raise the arms to a hugging position.

10 Claims, 9 Drawing Sheets

ACTUATING MECHANISM FOR DOLL

This application is a continuation of prior application Ser. No. 08/520,610, filed on Aug. 30, 1995, now abandoned.

BACKGROUND OF THE INVENTION

1. Field of the Invention

This invention relates generally to dolls, specifically to an actuating mechanism for animating a doll. 2. Prior Art A real person typically hugs by raising his or her arms, closing them around another person, opening them, and lowering them. Some mechanical dolls have been provided with actuating mechanisms for imitating a hug. U.S. Pat. No. 3,053,008 to Pelunis (1962) shows a hugging doll with a spring having a forwardly bowed middle portion positioned behind the chest, and end portions positioned in the arms. The junction between each end portion and the bowed middle portion includes a U-shaped portion positioned in a pivot. When the doll is hugged by a person, the bowed middle portion of the spring is pressed inwardly, and the ends of the spring are rotated forwardly about the pivots to wrap the doll's arms around the person, thus reciprocating the hug. When the doll is released, the arms spring backwardly to their original positions. However, the doll's arms only close and open in a horizontal plane, without rising and lowering like a real person's would.

U.S. Pat. No. 3,125,828 to Ostrander (1964) shows a hugging doll with two generally C-shaped rods each extended into the arm and leg on one side of the body. The rods are pivoted at the shoulders and hips, and include outwardly bowed middle portions positioned behind the chest. When the doll is hugged by a person, the chest and the middle portion of the rods are pressed inwardly, and the arms and legs are rotated by the ends of the rods forwardly. The arms of the Ostrander doll are also limited to dosing and opening; they do not rise and lower.

U.S. Pat. No. 4,212,132 to Lewanoni (1980) shows a hugging doll with the longer portions of two L-shaped members embedded in the arms. A hinge is arranged at the elbow of each L-shaped member. The shorter portions of the L-shaped members are connected to the doll's chest. When the doll is hugged by a person, the chest is moved inwardly, and the longer portions of the L-shaped members are rotated forwardly to create a hugging motion. The arms are incapable of rising and lowering.

U.S. Pat. No. 4,601,671 to DeMars (1986) shows a hugging doll with front and back plates spaced by resilient members. A pair of arms are hingeably connected to the front plate. A pair of connecting members hingeably connect the back plate to intermediate portions of the arms. When the front and back plates are compressed together against the resilient member, the connecting members push the arms forwardly to perform a hugging motion. The arms are incapable of rising and lowering.

U.S. Pat. No. 5,378,188 to Clark (1995) shows a hugging doll with front and back plates spaced by two pairs of opposing leaf springs set 90 degrees apart. The middle portions of the springs are connected to the arms and legs by tendons. When the doll is hugged by a person, the plates compress the springs, which flatten and extend outwardly in the vertical and horizontal directions. The extension of the springs pulls the tendons to close the arms and bend the legs in a hugging motion. Like other prior art dolls, the arms of the Clark mechanism are also incapable of rising and lowering.

OBJECTS OF THE INVENTION

Accordingly the primary object of the present invention is to provide an actuating mechanism for a doll that reciprocates a hug given to it by a person.

Another object of the present invention is to provide an actuating mechanism that includes arms that realistically rise and lower in addition to closing and opening.

Other objects of the invention will become apparent from a study of the following description and the accompanying drawings.

SUMMARY OF THE INVENTION

An actuating mechanism for a doll includes a pair of articulated arms rotatably attached, in a horizontal axis, to the upper end of an elongated vertical body member. A resilient deflectable member includes first and second ends, and outwardly bowing intermediate portions that are compressible inwardly. The first end of the deflectable member is fixedly attached to the body member. The second end of the deflectable member is movable downwardly when the member is compressed. A backwardly extending lever is attached orthogonally to the proximal ends of the arms. Tendons extending through the arms are positioned through and out the lever, down the front of the vertical body member, around the second end of the deflectable member, and up to an anchor on the back of the vertical body member. Portions of the tendons are offset forwardly of the arms' joints by being positioned away therefrom. When the deflectable member is compressed, such as when the doll is hugged, its second end is extended downwardly, so that the tendons are pulled downwardly along the vertical body member, and the lever is rotated forwardly. The arms are raised by the rotation of the lever, and are also contracted by the pull of the tendons to perform a hugging motion.

Figure 1:
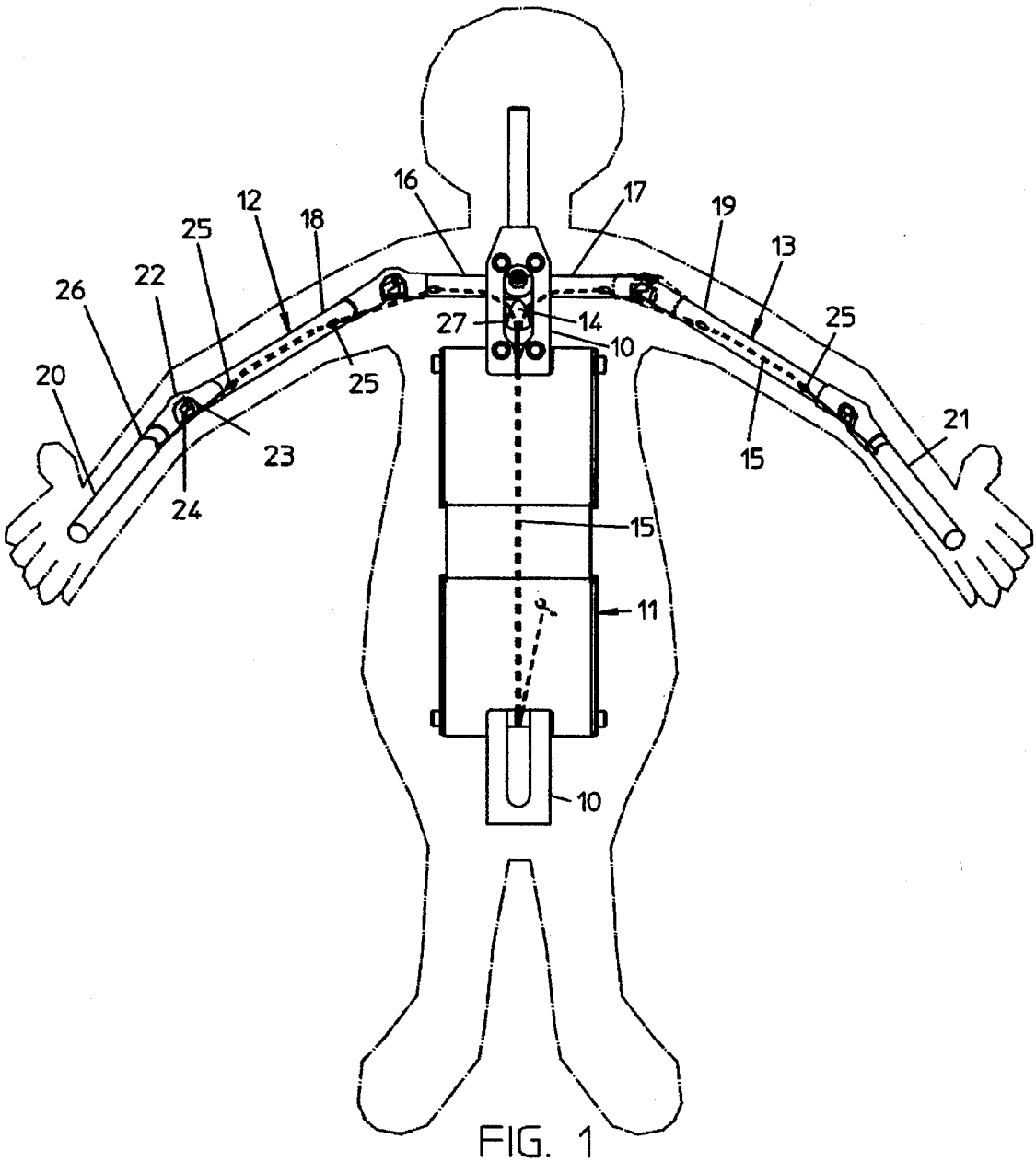
FIG. 1 is a from view of an actuating mechanism for a doll in accordance with a preferred embodiment of the invention.

| Drawing Reference Numerals | |
|---|---|
| 10. Body Member | 11. Resilient Deflectable Member |
| 12. Arm | 13. Arm |
| 14. Lever | 15. Tendons |
| 16. Shoulder | 17. Shoulder |
| 18. Upper Arm | 19. Upper Ann |
| 20. Forearm | 21. Forearm |

-continued

| Drawing Reference Numerals | |
|---|---|
| 22. Resilient Sleeves | 23. Hole |
| 24. Joints | 25. Holes |
| 26. First Ends Of Tendons | 27. Cavity |
| 28. Outwardly Bowing Intermediate Portion | 29. Outwardly Bowing Intermediate Portion |
| 30. Pivot | 31. Pivot |
| 32. Slot | 33. Slot |
| 34. Second Ends Of Tendons | 35. Bolt |
| 36. Rubber Bands | 37. Housing |
| 40. Holes | 41. Holes |
| 42. Holes | 43. Bolt |
| 44. First End Of Deflectable Member | 45. Second End Of Deflectable Member |

DESCRIPTION—FIGS. 1 TO 5—RELATED POSITION

In accordance with a preferred embodiment of the invention shown in the front view in FIG. 1, an actuating mechanism for a doll generally includes a vertical body member 10, a resilient deflectable member 11, a pair of appendages or arms 12 and 13 rotatably attached to an upper end of body member 10, a lever 14 extending rigidly and orthogonally from the proximal ends of arms 12 and 13, and a tendon 15 extending through each arm, out a lower end of lever 14, and down and around the bottom of deflectable member 11. The actuating mechanism is arranged within a toy figure or doll, so that body member 10 is positioned within the "torso", and arms 12 and 13 are positioned within the "arms" of the doll. The doll is not shown in subsequent drawing figures for clarity.

Arms 12 and 13 include shoulders 16 and 17, respectively, upper arms 18 and 19, respectively, and forearms 20 and 21, respectively, hingeably connected together. Shoulders 16 and 17 are rigidly connected together for simultaneous rotation about body member 10 in a horizontal axis. A resilient sleeve 22 with a hole 23 on a front portion thereof is positioned around each joint 24 in arms 12 and 13. Portions of tendons 15 are offset forwardly of joints 24 by being positioned through holes 25. A first end 26 of each tendon 15 is anchored on a respective forearm by being tied thereon. Lever 14 is positioned in a cavity 27 in the upper end of body member 10. Unlike prior art doll mechanisms, which keep their arms in permanently raised positions, arms 12 and 13 of the present actuating mechanism are in a relatively lower and more realistic position.

Figure 2:
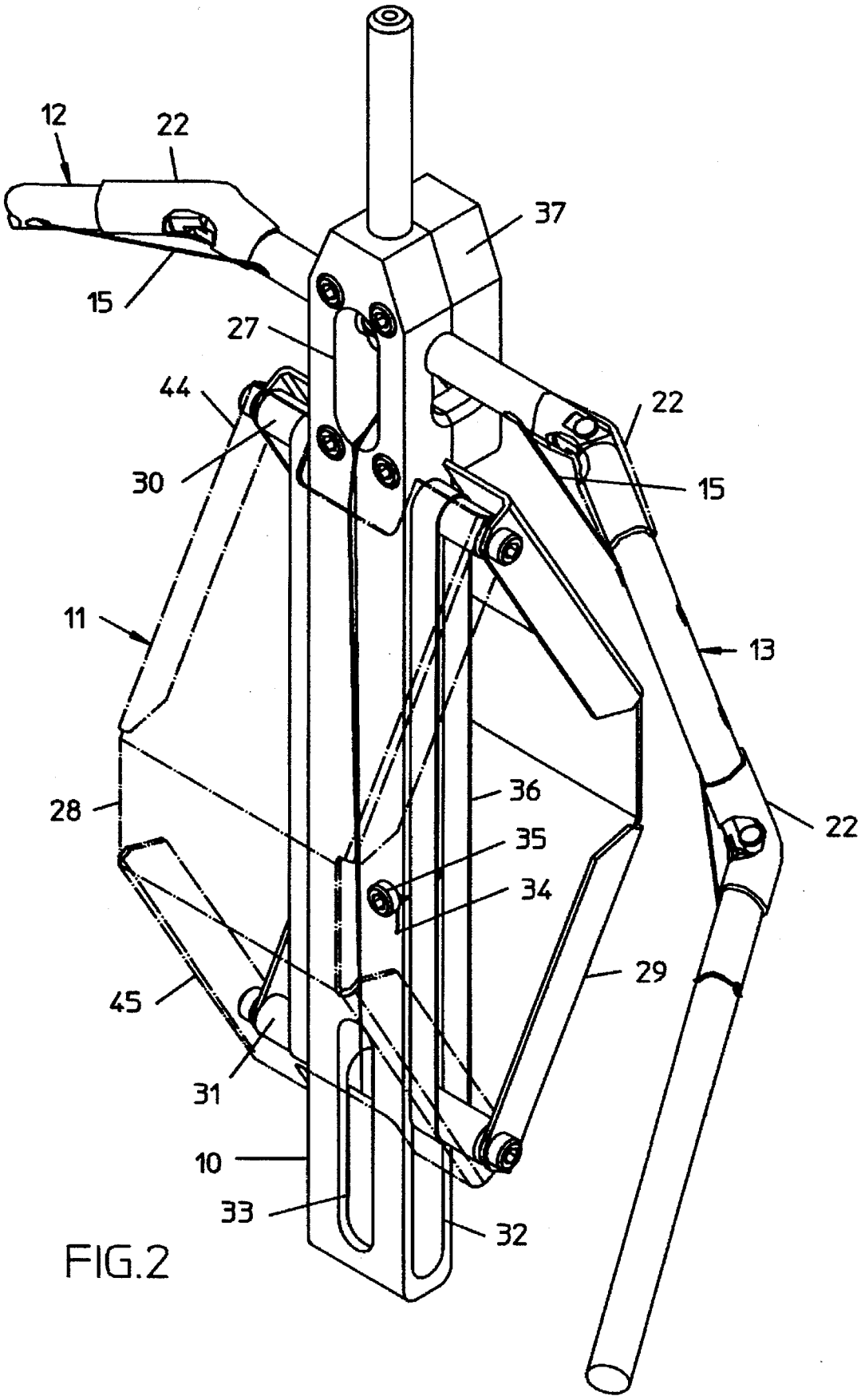
FIG. 2 is a front perspective view of the actuating mechanism with two arms in a lowered and relaxed position.

The actuating mechanism is shown in a front perspective view in FIG. 2. Deflectable member 11 includes outwardly bowing intermediate portions 28 and 29 that are pivotally connected at their first and second ends 44 and 45, respectively, by first and second pivots 30 and 31, respectively. Intermediate portion 28 is shown in phantom lines to make the parts therebehind visible. Pivot 30 is fixedly attached to the upper portion of body member 10, whereas pivot 31 is slidably positioned in a slot 32 extending between the sides of body member 10. Tendons 15 are positioned through the front of cavity 27, down the front of body member 10, and around bottom pivot 31 through a slot 33 extending through the front and back of body member 10. The second ends 34 of tendons 15 are anchored on the front of body 10 by a bolt 35. A pair of resilient tension means or rubber bands 36 are stretched between pivots 30 and 31 on either side of body member 10 to urge second pivot 31 upwardly, which causes intermediate portions 28 and 29 of deflectable member 11 to bow outwardly. A housing 37 is attached to the top rear of body member 10.

Figure 3:
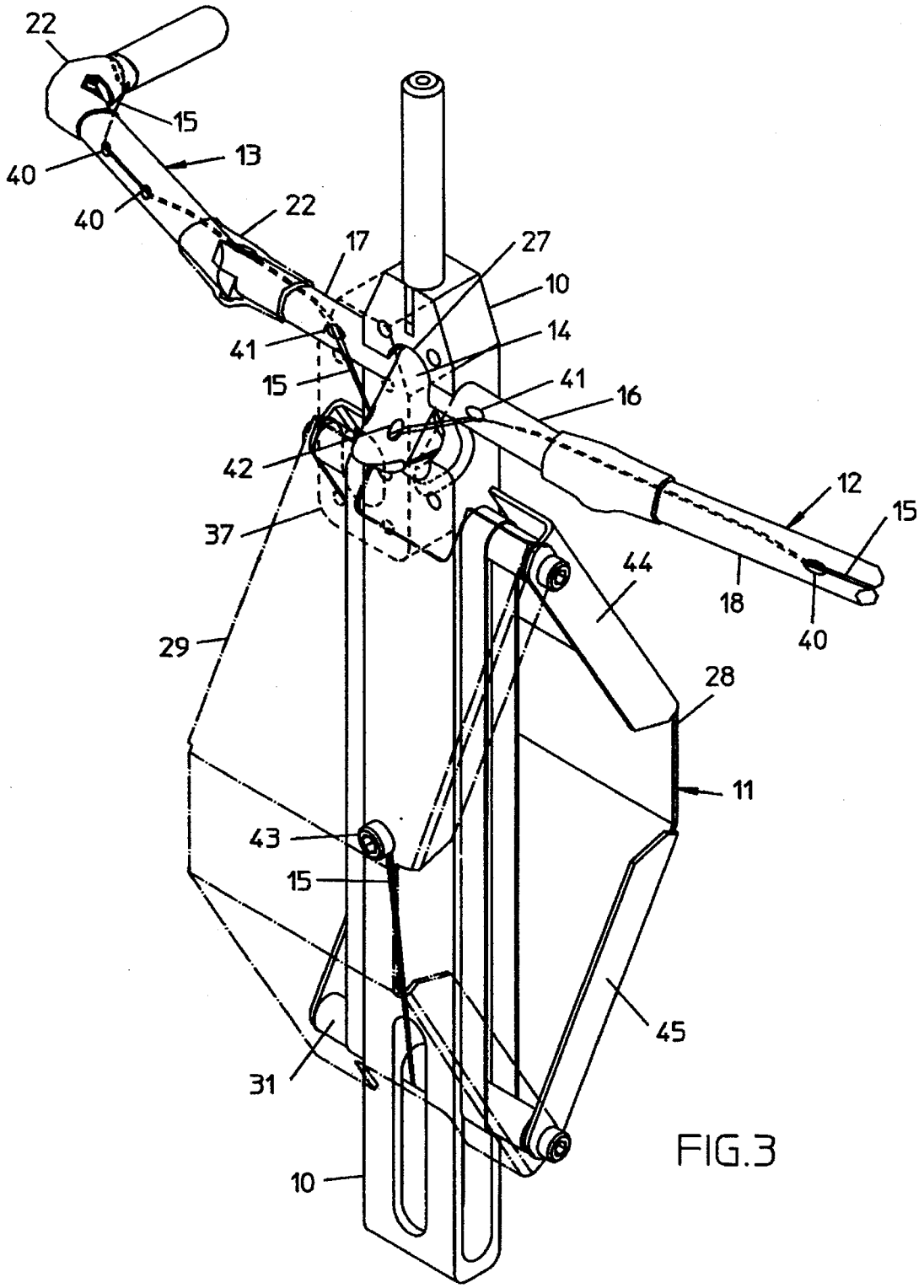
FIG. 3 is a rear perspective view of the actuating mechanism with the arms in a lowered and relaxed position.

The actuating mechanism is shown in a rear perspective view in FIG. 3. Intermediate portion 29 and housing 37 are shown in phantom lines to make the parts therebehind visible. Lever 14 is rigidly connected to the proximal ends of arms 12 and 13, and is angled backwardly and upwardly. A portion of each tendon 15 is positioned on the back of the upper arms by being threaded through holes 40. Tendons 15 exit the back of shoulders 16 and 17 through holes 41, extend into the back of lever 14 through holes 42, extend out the lower front of lever 14, and out the front of cavity 27. Tendons 15 are wrapped around pivot 31, up the back of body member 10, around a bolt 43, around the side of body member 10, and are anchored on the front of body member 10 by bolt 35 (FIG. 2).

Figure 4:
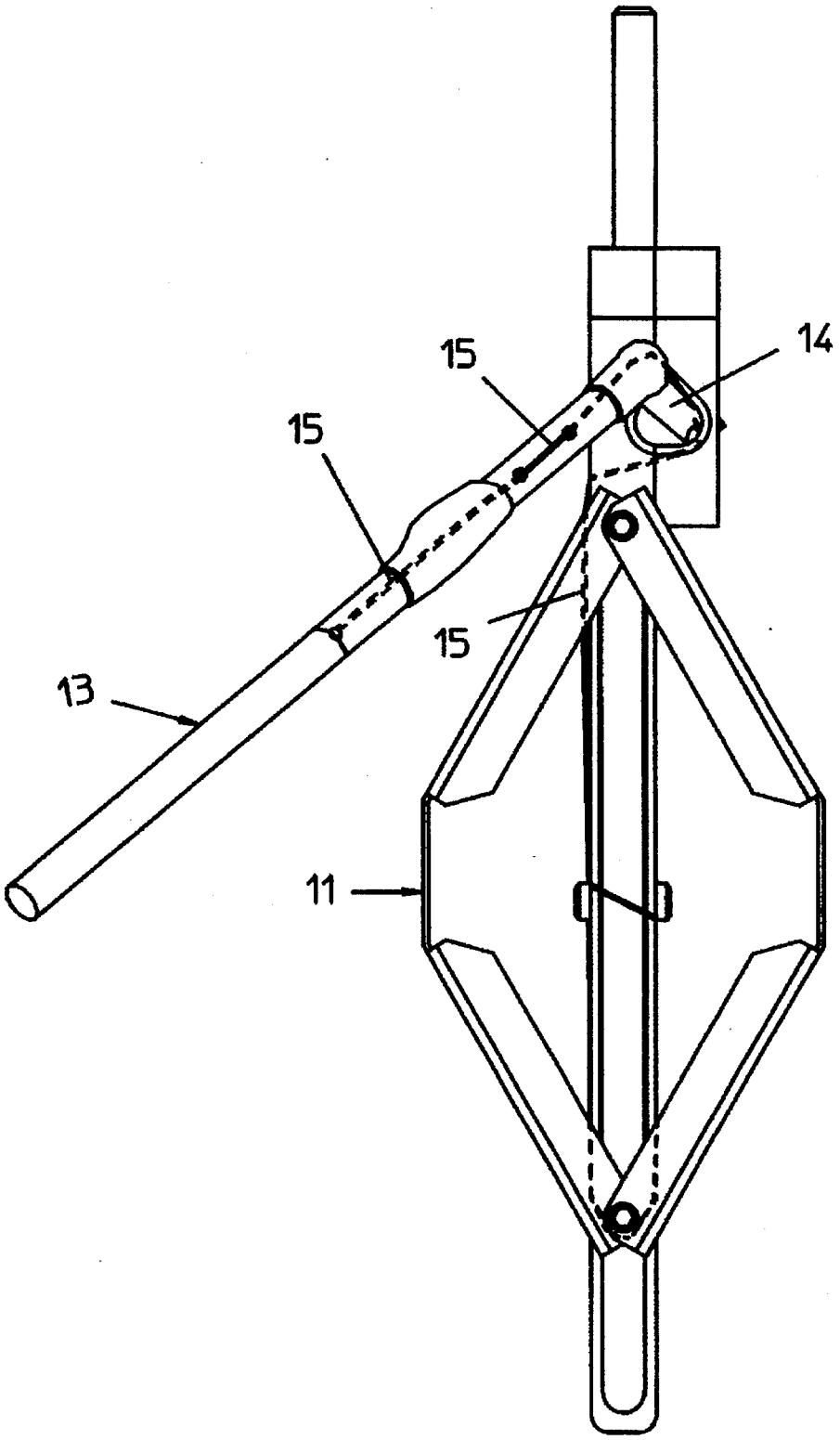
FIG. 4 is a side view of the actuating mechanism with the arms in a lowered and relaxed position.
Figure 5:
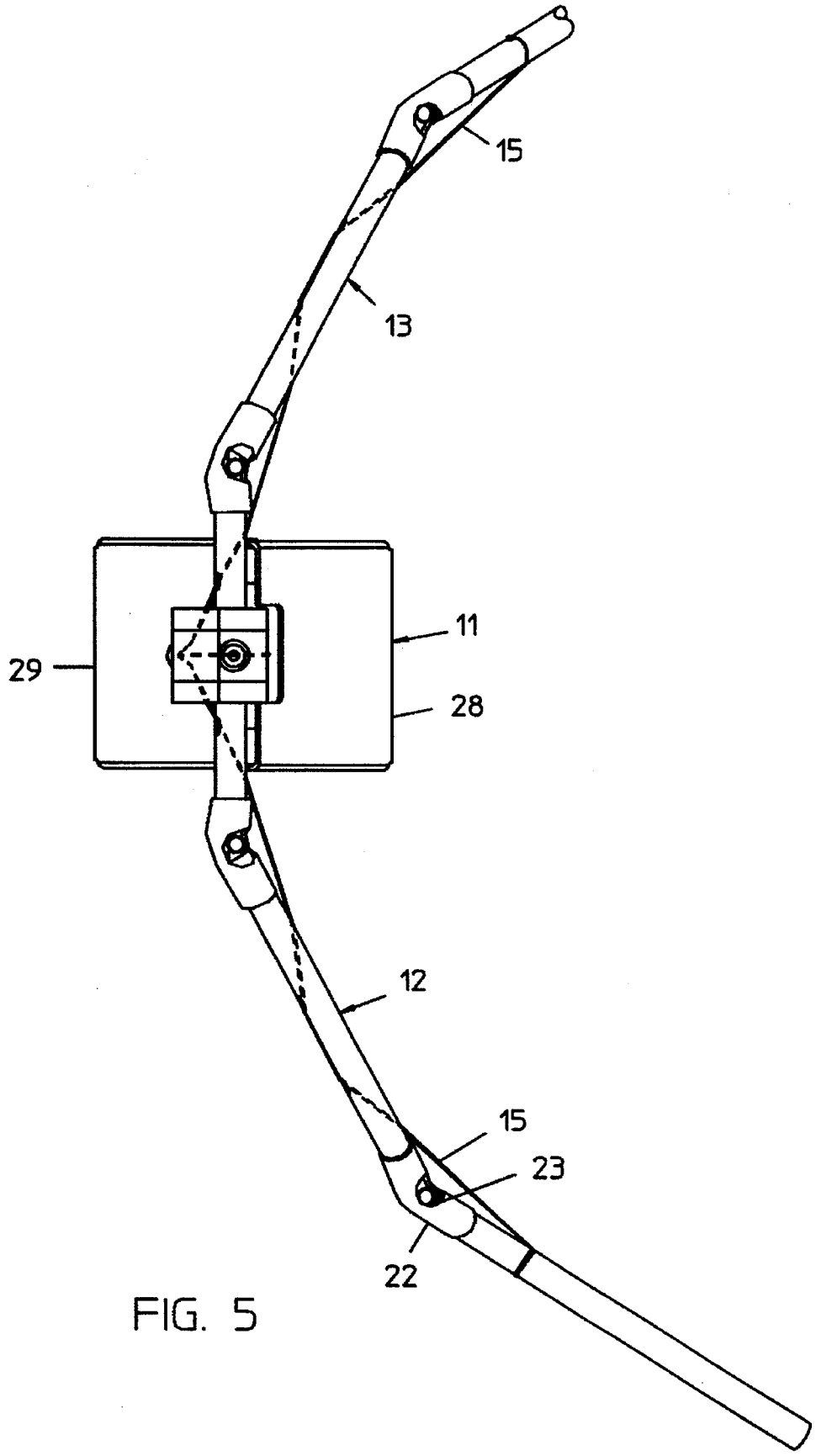
FIG. 5 is a top view of the actuating mechanism with the arms in a lowered and relaxed position.

The actuating mechanism is shown in left side and top views in FIGS. 4 and 5, respectively. Arms 12 and 13 are in a down and outstretched position, and lever 14 is positioned backwardly and upwardly. Resilient member 11 is retracted upwardly, and expanded outwardly in the front and back directions. Tendons 15 exit the distal end of lever 14 at an angle of about 90 degrees. Holes 23 in sleeves 22 allow the bending of arms 12 and 13.

DESCRIPTION—FIGS. 6 TO 9—HUGGING POSITION

Figure 6:
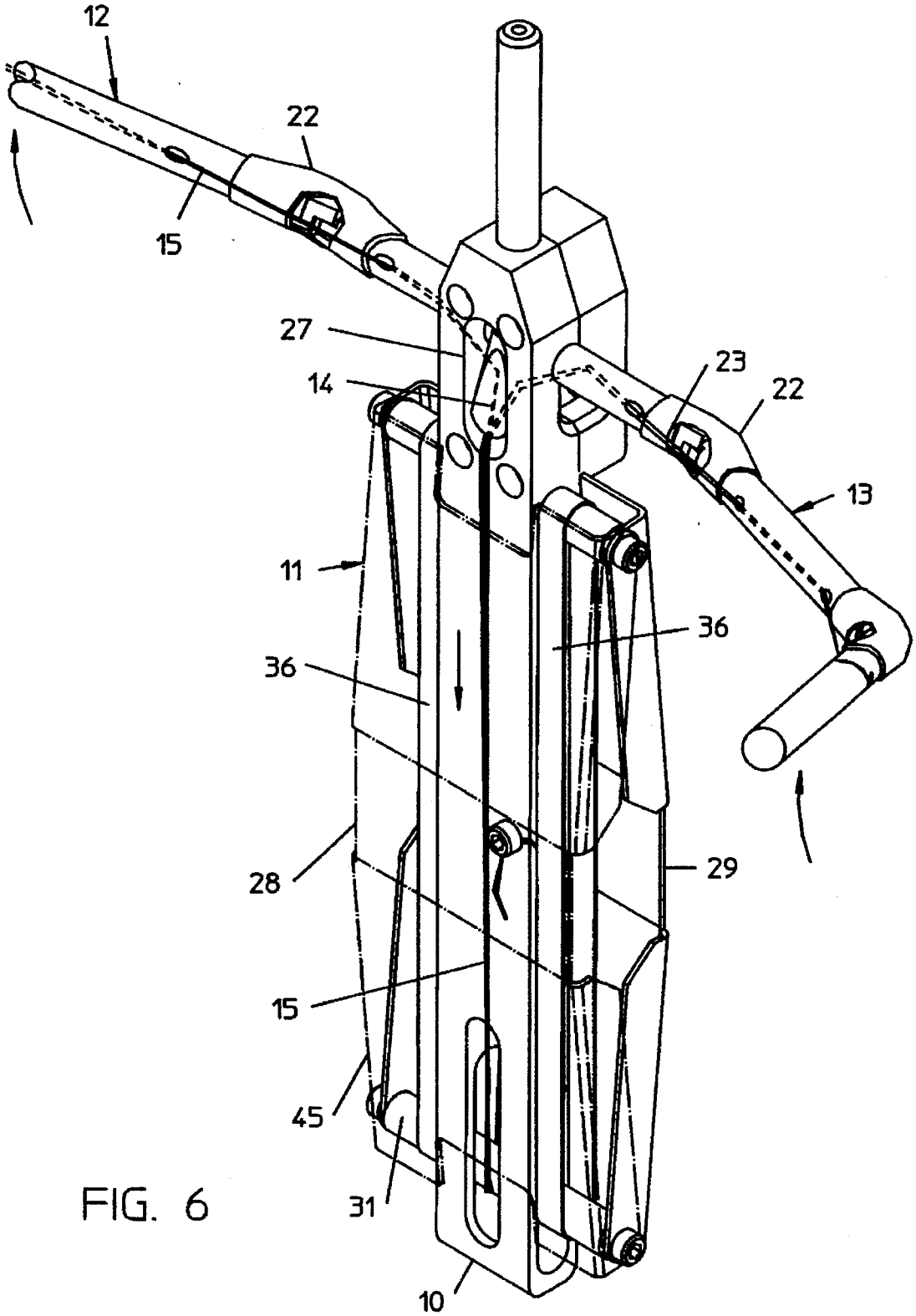
FIG. 6 is a front perspective view of the actuating mechanism with the arms in a raised and closed position.
Figure 7:
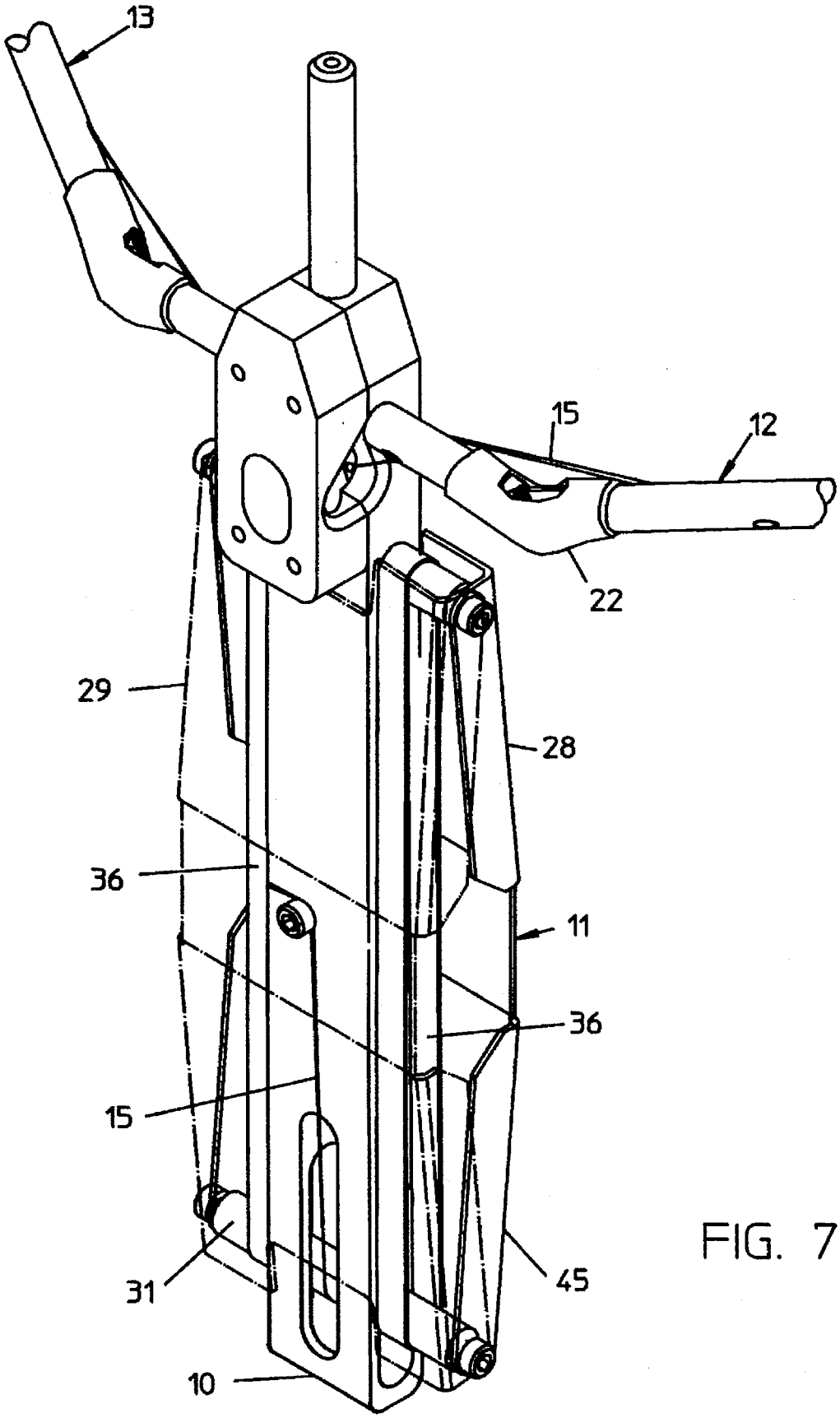
FIG. 7 is a rear perspective view of the actuating mechanism with the arms in a raised and closed position.
Figure 8:
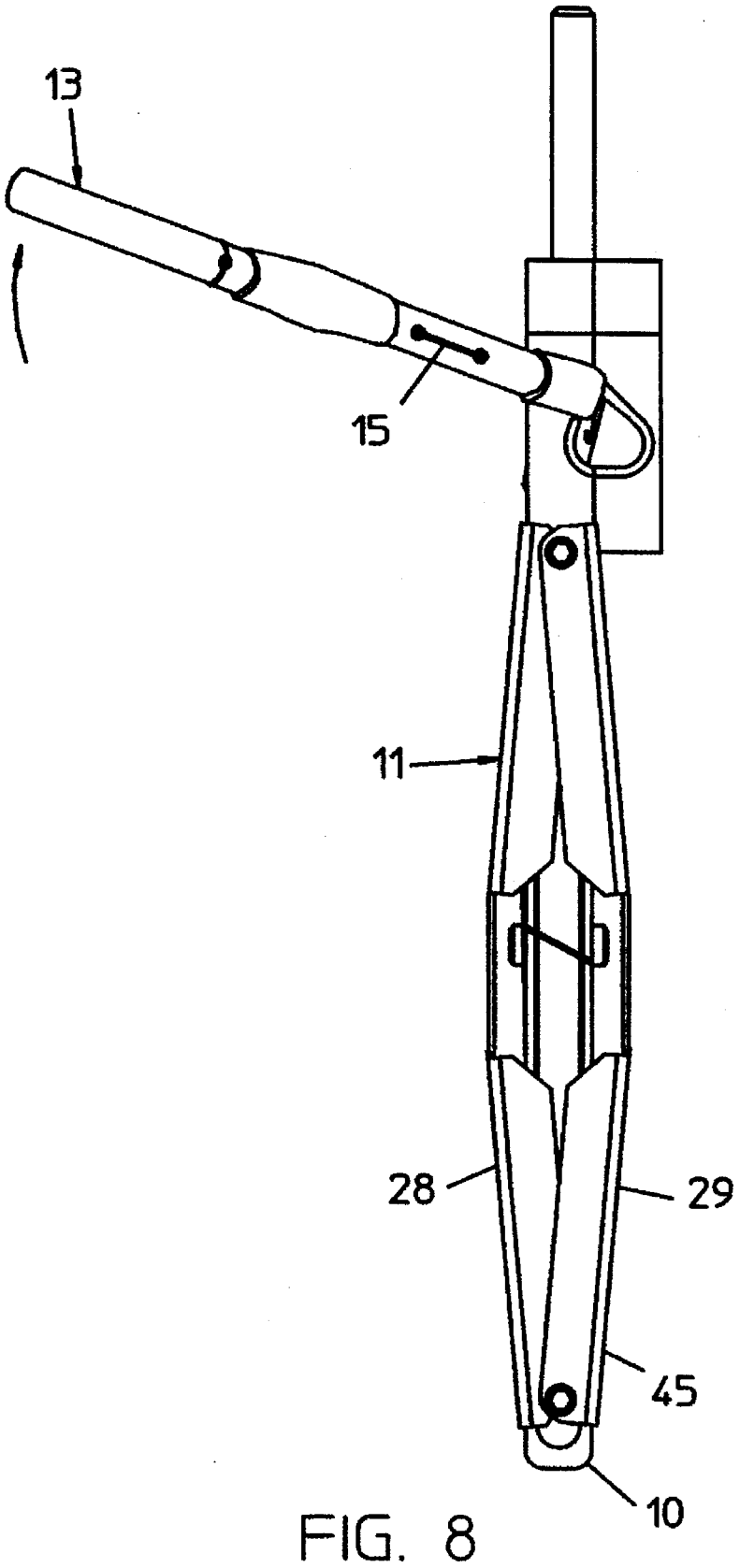
FIG. 8 is a side view of the actuating mechanism with the arms in a raised and dosed position.
Figure 9:
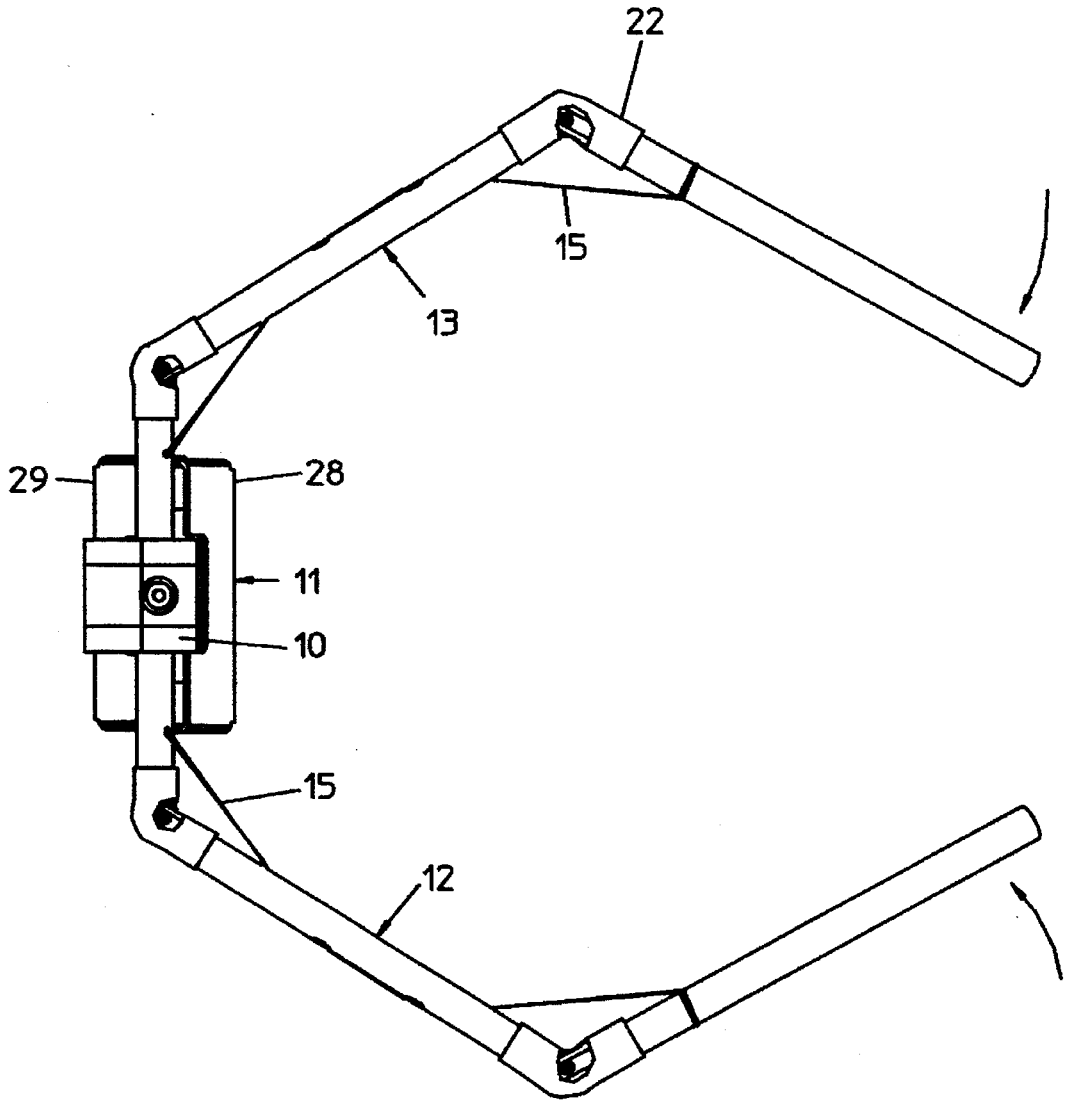
FIG. 9 is a top view of the actuating mechanism with the arms in a raised and closed position.

The actuating mechanism is shown in front perspective, rear perspective, side, and top views in FIGS. 6 to 9, respectively, in a hugging position. Deflectable member 11 is compressed by a force applied horizontally thereto, such as a person hugging the doll (not shown), so that intermediate portions 28 and 29 are deflected inwardly toward each other, and second end 45 is deflected downwardly. The portions of tendons 15 adjacent body member 10 are pulled downwardly, so that lever 14 is rotated to the front of cavity 27, as shown in FIG. 6, and arms 12 and 13 are lifted upwardly, as indicated by the arrows in FIG. 8. When arms 12 and 13 are lifted, they are simultaneously moved toward each other or closed by tendons 15, as indicated by the arrows in FIG. 9. Therefore, when the doll (not shown) is hugged, the mechanism will realistically raise its arms and reciprocate the hug.

When the doll is released, pivot 31 and second end 45 of deflectable member 11 are pulled upwardly by rubber bands 36. Arms 12 and 13 are returned to the open position by resilient sleeves 22, and are also returned to the lowered position by gravity, as shown in FIG. 2.

Conclusion, Ramifications, And Scope

Accordingly the reader will see that I have provided an actuating mechanism for a doll that reciprocates a hug given to it by a person. When relaxed, its arms are in a realistic, lowered position. When it is hugged, it reciprocates the hug by realistically raising its arms, and closing them around the person. It realistically opens and lowers its arms when released.

Although the above descriptions are specific, they should not be considered as limitations on the scope of the invention, but only as examples of the preferred embodiment. Many other ramifications and variations are possible within the teachings of the invention. For example, rubber bands 36 can be replaced with compression springs. Deflectable member 11 can be made resilient enough to automatically retract to its original position when released, so that rubber bands 36 can be eliminated. Instead of having separate sections joined by pivots, arms 12 and 13 can each be made as an integral, resilient appendage that flexes at the shoulder and elbow, such as those shown in U.S. Pat. No. 5,378,188 to Clark. Therefore, the scope of the invention should not be determined by the examples given, but by the appended claims and their legal equivalents.

We claim:

1. A doll, comprising:

a body member having left and right sides;

a pair of arms attached one to each side of said body member, each of said arms comprising:

a generally horizontal shoulder having an inner end pivotally attached to said body member for rotation about a generally horizontal first axis, an elongated upper arm having an upper end pivotally attached to an outer end of said shoulder for rotation about a second axis generally perpendicular to said upper arm;

an elongated forearm having an upper end pivotally attached to a lower end of said upper arm for rotation about a third axis generally perpendicular to said forearm;

wherein said arms are movable between a lowered position and a raised position relative to said body member, said upper arms are movable inwardly and outwardly relative to said body member, and said forearms are also movable inwardly and outwardly relative to said body member, so that said arms are movable between an open position away from each other and a closed position closer to each other; and actuating means for simultaneously raising and closing said arms, and simultaneously lowering and opening said arms.

2. The doll of claim 1 wherein said actuating means is responsive to pressure from a user, so that said actuating means raises and closes said arms when pressure is applied to said actuating means, and lowers and opens said arms when pressure is released from said actuating means.

3. A doll, comprising:

an elongated body member;

a resilient deflectable member having first and second ends and spaced apart outwardly bowing intermediate portions, said first end of said deflectable member being fixedly attached to said body member and said second end of said deflectable member being movable longitudinally along said body member, so that when said intermediate portions of said deflectable member are compressed together, said second end of said deflectable member is deflected away from said first end of said deflectable member; and a tendon having a first end and a second end, said second end of said tendon being anchored on said body member at a position between said first and second ends of said deflectable member, said tendon curving around said second end of said deflectable member, and extending past said first end of said deflectable member;

whereby when said outwardly bowing intermediate portions of said deflectable member are compressed together, said second end of said deflectable member is deflected away from said first end thereof, and an intermediate portion of said tendon is pulled by said second end of said deflectable member.

4. The doll of claim 3, further including resilient tension means for urging said first and second ends of said deflectable member toward each other.

5. The doll of claim 4 wherein said resilient tension means comprises a pair of rubber bands stretched between said first and second ends of said deflectable member.

6. The doll of claim 3, further including a pair of arms hingeably attached to said body member.

7. A doll, comprising:

an elongated body member;

a pair of arms each having a proximal end rotatably attached to said body member in a horizontal axis, so that said arms are rotatable between a lowered position and a raised position, each of said arms having a distal end;

a lever connected orthogonally to said proximal ends of said arms for rotating said arms;

a resilient deflectable member having first and second ends and spaced apart outwardly bowing intermediate portions, said first end of said deflectable member being fixedly attached to said body member and said second end of said deflectable member being movable longitudinally along said body member, so that when said intermediate portions of said deflectable member are compressed together, said second end of said deflectable member is deflected away from said first end thereof; and a pair of tendons each having a first end and a second end, said first end of each tendon being connected to one of said arms, said second end of each tendon being anchored on said body member at a position between said first and second ends of said deflectable member, each tendon curving around said second end of said deflectable member, extending past said first end of said deflectable member; through a distal end of said lever, and into a respective one of said arms;

whereby when said outwardly bowing intermediate portions of said deflectable member are compressed together, said second end of said deflectable member is deflected away from said first end thereof, and intermediate portions of said tendons are pulled by said second end of said deflectable member, so that said distal end of said lever is pulled by said tendons to rotate said arms from said lowered position to said raised position.

8. The doll of claim 7, further including resilient tension means for urging said first and second ends of said deflectable member toward each other.

9. The doll of claim 8 wherein said resilient tension means comprises a pair of rubber bands stretched between said first and second ends of said deflectable member.

10. The doll of claim 7 wherein said pair of arms each includes a hinge between said proximal end and said distal end, so that said arms are movable between an open position away from each other and a closed position closer to each other.

* * * * *